United States Patent [19]

Dingli

[11] 4,341,298

[45] Jul. 27, 1982

[54] FORMING GROUPS OF ROD-LIKE ARTICLES

[75] Inventor: Paul Dingli, Winslow, England

[73] Assignee: Molins Limited, London, England

[21] Appl. No.: 121,335

[22] Filed: Feb. 13, 1980

[30] Foreign Application Priority Data

Feb. 20, 1979 [GB] United Kingdom ..... 7905951

[51] Int. Cl.[3] ..... B65B 19/10

[52] U.S. Cl. ..... 198/419; 53/151; 221/68; 221/264; 414/41

[58] Field of Search ..... 414/30, 41, 47, 63; 131/25; 53/148–151; 198/419, 420, 451; 221/268, 273, 274, 68, 264

[56] References Cited

U.S. PATENT DOCUMENTS

| | | | |
|---|---|---|---|
| 1,647,265 | 11/1927 | Bronander | 53/150 X |
| 3,372,790 | 3/1968 | Pembroke et al. | 198/451 X |
| 3,435,940 | 4/1969 | Seragnoli | 198/420 X |
| 3,603,445 | 9/1971 | Zausch et al. | 198/419 |

FOREIGN PATENT DOCUMENTS

| | | | |
|---|---|---|---|
| 1912651 | 10/1970 | Fed. Rep. of Germany | 198/419 |
| 2327916 | 12/1973 | Fed. Rep. of Germany | 53/151 |
| 2243911 | 3/1974 | Fed. Rep. of Germany | 53/150 |
| 1159792 | 7/1969 | United Kingdom | 198/419 |
| 1168447 | 10/1969 | United Kingdom | 53/151 |
| 1519593 | 8/1978 | United Kingdom | 198/451 |

*Primary Examiner*—Leslie J. Paperner

*Attorney, Agent, or Firm*—John C. Smith, Jr.

[57] ABSTRACT

A non-intermittent cigarette bundle forming device comprises three hoppers, one for each cigarette row. An oscillating ladder (23) at the bottom of each hopper provides an escapement mechanism for a row to form in front of a gate (6). On release of the gate (6, and 7A to 7C), a cigarette row rolls down a passageway into a continuously moving container (9), in which the three-row bundle is formed.

8 Claims, 5 Drawing Figures

FORMING GROUPS OF ROD-LIKE ARTICLES

This invention is concerned with the forming of groups of rod-like articles, in particular cigarettes.

A common method of forming groups or bundles of cigarettes, each arranged in a plurality of rows suitable for subsequent packaging, is to allow cigarettes which are lying horizontally in a hopper to pass down vertical columns, at the bottom of which the required number of rows are discharged axially at the desired rate. With increasing speeds of cigarette packaging machines two disadvantages arise with this method. First, the cigarettes may become damaged by the impact of being suddenly discharged, in particular tobacco tends to fall out of the ends of the cigarettes. Secondly, since the cigarettes are only urged downwardly by gravity, a given time is required for the cigarettes to fall down to the discharge position; e.g. a time of about 0.1 secs. is required for cigarettes to drop a distance of three rows (i.e. 3 cigarette diameters). This time cannot be reduced, consequently a disproportionally shorter time becomes available for the cigarettes to be discharged for a given increase in packaging speed, resulting in turn in an aggravation in the damage to the cigarettes.

It is an object of the present invention to provide apparatus for forming groups of rod-like articles which allows the groups to be formed in a more continuous manner, thereby mitigating the aforementioned disadvantages.

According to the invention there is provided apparatus for forming groups of rod-like articles, each group containing a plurality of superposed rows of articles, comprising a conveyor movable continuously along a substantially rectilinear path and supporting a series of group-receiving containers, means defining a plurality of parallel passageways corresponding in number to the said plurality of superposed rows to be formed, said passageways being disposed above said conveyor for passing articles transversely of their axes to said containers, each passageway having an exit portion inclined towards said conveyor in the direction of movement thereof, and feed means for feeding the required number of articles through each respective passageway in timed relationship with the movement of said containers beneath, so that a row of articles is progressively formed in each said container as it passes each exit portion of a passageway.

Each said passageway may comprise a conveyor movable at a speed such that its component of motion parallel with the path of the containers is equal to the speed of the containers.

The containers may be U-shaped, each comprising a horizontal base and two walls disposed perpendicular to the base. Where there are three rows of articles, e.g. cigarettes, and the number of cigarettes in the middle row is one less than that in the bottom row, the two walls may be formed internally with protrusions to urge the middle row to "nest" with the bottom row, so that each cigarette in the middle row is in contact with two cigarettes of the bottom row. The walls of each container may be provided with a gap to enable them to straddle the exit portions of the passageways.

A row forming device may be disposed upstream of each said member comprising means defining a plurality of vertical columns of articles, which correspond in number to the number of articles in a row, a fixed stop at the bottom of each column, at least one horizontal opening at one side of each column immediately above said stop, and cyclic means to eject the lowermost article in each column laterally out of said opening, for collection at said gate member.

Preferably there are two openings at the bottom of each column, one opening at each side, and the cyclic means comprises a horizontally reciprocating ladder having a plurality of equispaced rungs, there being provided two rungs for each column plus one further rung, so that there is a rung alternately passing across said two openings of each column.

In modification of the row forming device the fixed stop is replaced by a movable stop, and the second article from the bottom in each column is selectively held back in the column by suction applied to the article at the side of the column, so that single articles are released by alternately holding up the column by engagement of the movable strip with the lowermost article and applying suction to said second article. The lower ends of the two outermost columns, instead of being vertical, may be convergent, for example horizontal.

The invention will now be described, by way of example, with reference to the accompanying drawings, in which.

Figure 1:
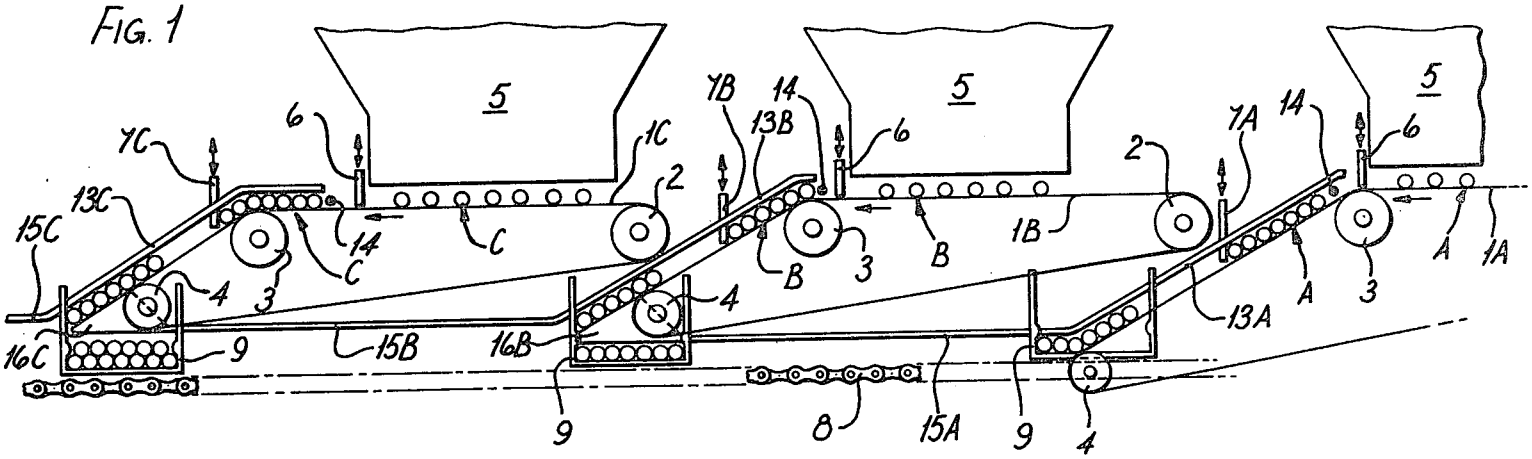
FIG. 1 is a side view of apparatus for forming groups of rod-like articles.

Referring first to FIG. 1, there are shown three continuously moving conveyors 1A, 1B and 1C, each passing around three pulleys 2, 3 and 4. Between pulleys 2 and 3 the run of each conveyor is horizontal, moving towards the left as shown by the arrows, while the run between pulleys 3 and 4 is downwardly inclined by an angle of about 30° from the horizontal. The inclined run of the conveyors 1B and 1C is successively shorter than that of conveyor 1A, the reason for which will become apparent below.

Above the horizontal run of each conveyors 1A, 1B and 1C is mounted a hopper 5 from which individual rows of cigarettes A, B and C respectively are regularly formed by a device to be described below. The middle one of the three hoppers 5 releases rows B of six cigarettes, while the two outer hoppers 5 release rows A and C of seven cigarettes each.

Immediately to the left of each hopper 5 is a vertically movable gate 6, where the released rows A to C are collected side-by-side before being allowed to pass to respective similar gates 7A, 7B and 7C.

Figure 4:
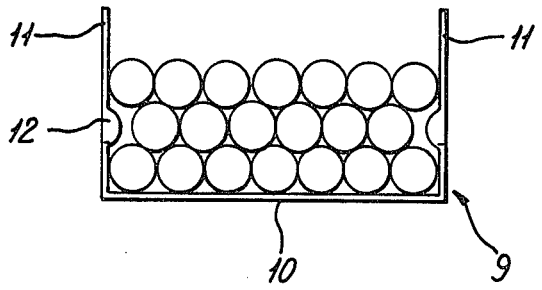
FIG. 4 is an enlarged view of a container shown in FIG. 1.

Beneath the three conveyors 1A, 1B and 1C is disposed a continuously moving chain conveyor 8 which supports a number of regularly-spaced containers 9. One of the containers 9 is shown enlarged in FIG. 4, and consist of a base 10 and two vertical walls 11. Each container 9 is adapted to receive a group of twenty cigarettes arranged in three rows, i.e. of seven, six and seven cigarettes. Level with the middle row (provided by the row B) each wall is formed with an internal protrusion 12; these urge the middle row into a nesting relationship, so that each cigarette of the middle row is in contact with two cigarettes of the bottom row, as shown in FIG. 4.

Each of the containers 9 is, in fact, formed as two side-by-side halves spaced apart by a gap whose width is just sufficient for the two halves to pass on either side of the inclined run of the conveyors 1A to 1C.

Extending parallel to each inclined run of the conveyors 1A, 1B and 1C are guide plates 13A, 13B and 13C respectively, which are spaced from the conveyors by a distance slightly greater than a cigarette diameter; thus there is formed there between an inclined passageway down which the respective rows of cigarettes A to C can pass. Upstream of each gate 7A, 7B and 7C is an electronic cigarette counter 14, up to which extend the upper ends of the plates 13A to 13C; for conveyor 1C the plate 13C extends partly also into the end of the horizontal run.

The operation of the apparatus described is as follows: the rows A to C are dispensed from the hoppers 5, by a device to be described below, and then form in front of the gates 6; from here they are released at a predetermined timing. The cigarettes then pass the respective counters 14 which ensure that each row contains the correct number of cigarettes, i.e. seven cigarettes in rows A and C, and six in row B.

As a container 9 passes below each gate 7A to 7C the rows A to C are released by the respective gates and allowed to continue down the respective passageway to form a row in each container. Thus the row A is fed progressively as shown onto the base 10 of a container 9 to form the bottom row, and the cigarettes of this row are prevented from being displaced from the base by a horizontal extension 15A of the plate 13A. Similarly the row B forms the nested middle row of the respective container passing at that moment beneath it, which has already received the bottom row, and this middle row is likewise prevented from being displaced from its nested position by an extension 15B of the plate 13B; and row C forms the top row of the container, and is similarly prevented from being displaced by an extension 15C of the plate 13C.

It will be noted that the front protrusion 12 ensures that the first cigarette of the middle row is displaced rearwardly relative to the bottom row, so that it and the remaining cigarettes of that row adopt the nested position shown.

Since only the inclined run of conveyor 1A passes fully between the two halves of each container 9, the left-hand ends of conveyors 1B and 1C adjacent the pulleys 4 are each provided with a fixed triangular ramp 16B,16C. These ramps allow the rows B or C to be lowered right down on to the bottom or middle row respectively of a container 9, in the same way as the conveyor 1A allows the row A to be lowered right on to the base 10 to form the bottom row.

It will be seen from FIG. 1 that the pulleys 4 of the conveyors 1A to 1C need to be successively higher relative to the containers 9. For this reason the inclined runs of the conveyors 1B and 1C are shorter than that of the conveyor 1A, as previously noted.

Figure 2:
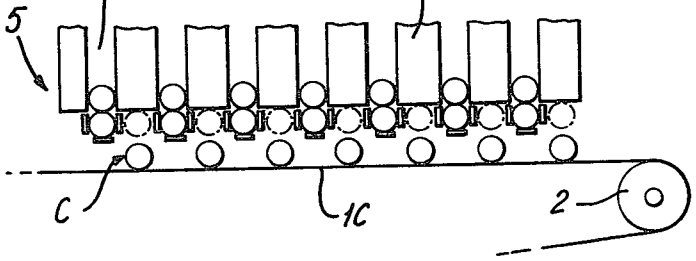
FIG. 2 is an enlarged view of a device of the apparatus of FIG. 1.

Referring now to the dispensing device of FIG. 2, there is shown an enlarged view of the conveyor 1C and its associated hopper 5. Towards the bottom of the hopper are provided eight vertical vanes 20, which define seven channels 21 each of a width corresponding to the diameter of a cigarette; thus seven vertical columns of cigarettes are formed.

Figure 3:
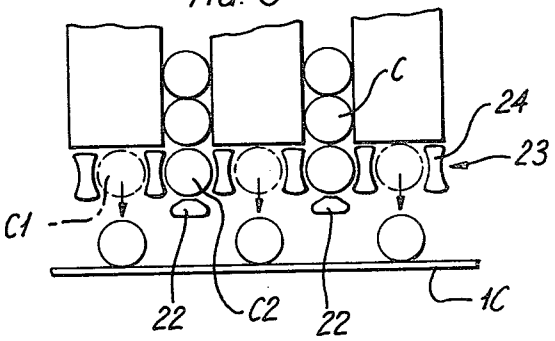
FIG. 3 is a further enlargement of part of the device shown in FIG. 2.

Beneath each channel 21 is a fixed stop 22 whose shape, as seen in the further enlarged view of FIG. 3, consists of a somewhat rounded triangle whose apex is uppermost. Between each stop 22 and the bottom of the vertical channel, there is at each side a horizontal opening slightly wider than the diameter of a cigarette C. Formed across these openings is a ladder 23 having fifteen rungs 24, i.e. two for each channel plus one. FIG. 3 shows how each rung 24 is of a concave shape at each side, having a radius of curvature greater than the radius of the cigarettes.

The ladder 23 is reciprocated so that at its extremity of movement a cigarette, such as C1, is in a position between two channels where it is no longer supported by a stop 22. Thus it drops from between the rungs 24 onto the conveyor 1C, forming with the other cigarettes a row C of seven cigarettes. When the ladder 23 is reciprocated to its opposite extremity each next cigarette in a channel 21, such as cigarette C2, will similarly be released to form part of the next row C.

It will be apparent that the apparatus described allows cigarettes to be formed rapidly from the channels 21 of the hopper 5, since they only need to drop a distance slightly greater than a cigarette diameter. Furthermore, once the rows of cigarettes have been formed in front of the gates 7A to 7C, they are moved in a continuous manner into the containers 9. The chain conveyor 8 is thus able to move continuously, allowing the apparatus to operate at higher speeds without the disadvantages associated with intermittent motion. From the container 9 the cigarette groups may be transferred to packet forming apparatus in a manner well known in the art.

Figure 5:
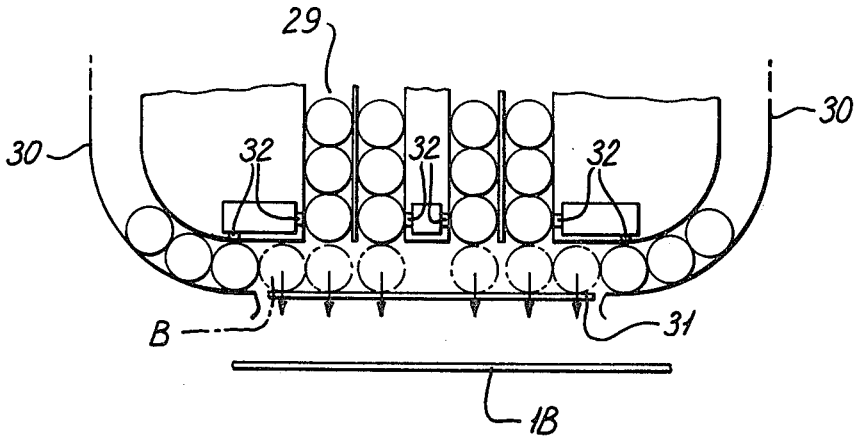
FIG. 5 is a modification of the device of FIGS. 2 and 3 for forming individual rows of cigarettes.

FIG. 5 shows a modification of the dispensing device described with reference to FIGS. 2 and 3. In this case the device forms a row of six cigarettes, e.g. as required for the middle of the three hoppers 5 shown in FIG. 1. The device comprises four vertical channels 29 and two outer channels 30 whose lower ends are curved horizontally inwards. Beneath the channels 29 and 30 is a flat stop 31 formed in two halves to support opposite ends of a row B of six cigarettes (shown chain-dotted). The two halves of the stop 31 are (perpendicular to the plane of FIG. 1) horizontally out of engagement with the cigarettes. At the end of each of the channels 29 and 30 is a suction port 32 against which the foremost cigarette in the channel can be selectively held by suction, so that the whole column of cigarettes in that channel is arrested.

In operation, with the row B of six cigarettes resting on the stop 31 and suction applied to the ports 32, the stop is slid open, releasing the row of cigarettes onto conveyor 1B. The stop 31 is then immediately brought back into position, and suction released from each of the ports 32.

This allows the cigarettes in each channel to move on by one cigarette diameter, so that a leading cigarette from each channel rests on the stop 31, thereby forming a further row B.

In the case of a hopper for dispensing a row of seven cigarettes, a similar device may be utilised except that there will be a fifth vertical channel 29, likewise having a suction port 32 at its bottom end.

I claim:

1. Apparatus for forming groups of rod-like articles, each group containing a plurality of superposed rows of articles, comprising a conveyor movable continuously along a substantially rectilinear path and comprising a series of group-receiving containers, means defining a plurality of parallel passageways corresponding in number to said plurality of superposed rows to be formed, said passageways being disposed above said conveyor for passing articles transversely of their axes to said containers, each passageway having an exit portion inclined towards said conveyor in the direction of movement thereof, feed means for feeding the required number of articles through each respective passageway in timed relationship with the movement of said containers therebeneath, so that a row of articles is progressively formed in each said container as it passes each exit portion of a passageway, said feed means comprising a gate member for collecting a row of articles at each passageway and being openable as each container passes said exit portion, and a row forming device disposed upstream of each of said passageways and comprising means for supporting a plurality of vertical columns of articles, which correspond in number to the number of articles in a row, a fixed stop at the bottom of each column, two openings at the bottom of each column, one opening at each side, and cyclic means to eject the lowermost article in each column laterally out of said opening for collection at said gate member, said cyclic means comprising a horizontally reciprocating ladder having a plurality of equispaced rungs, there being provided two rungs for each column plus one further rung, so that there is a rung alternately passing across said two openings of each column.

2. Apparatus according to claim 1 in which each of said containers is U-shaped and comprises a horizontal base, a leading wall and a trailing wall, each said wall being perpendicular to said base.

3. Apparatus according to claim 2, wherein three of said passageways are provided, so that in use three rows of articles are formed in each container, wherein said feed means is adapted to feed one less article to the passageway corresponding to the middle of said three rows than to that of the bottom row, and wherein the inside of at least said leading wall of each container is provided with a protrusion, so that said middle row is caused to nest relative to the said bottom row.

4. Apparatus according to claim 2 in which said walls of each container are formed with a gap to enable said walls to straddle said exit portions of the passageways.

5. Apparatus for forming groups of rod-like articles, each group consisting of a plurality of superposed rows of articles, comprising:

(a) a conveyor movable along a substantially rectilinear path and comprising a series of group-receiving containers;

(b) means for driving said conveyor at a continuous speed;

(c) means defining a plurality of parallel passageways corresponding in number to said plurality of superposed rows to be formed, said passageways being disposed successively above said conveyor for passing articles transversely of their axes to said containers;

(d) each passageway having an inlet portion and an exit portion, said exit portion being inclined at an acute angle towards said conveyor in the direction of movement thereof;

(e) first feed means for intermittently feeding a required number of articles through said inlet portion of each respective passageway to form a row of said articles at a predetermined position in said passageway; and (f) second feed means for feeding said row of the required number of articles through said exit portion of each respective passageway in timed relationship with the movement of said containers therebeneath, so that a row of articles is progressively formed in each said container as it sequentially passes each exit portion of a passageway.

6. Apparatus according to claim 5 in which said second feed means comprises a gate member at said inclined exit portion of each passageway for marshalling each successive required row of articles at each said passageway, the gate member being openable as each container moves beneath said exit portion, so that respective rows of articles descend by gravity down said exit portions to progressively form a group of articles in each passing container.

7. Apparatus according to claim 6 in which a row forming device is disposed upstream of each said gate member and comprises means for supporting a plurality of vertical columns of articles, which correspond in number to the number of articles in a row, a fixed stop at the bottom of each column, at least one horizontal opening at one side of each column immediately above said stop, and cyclic means to eject the lowermost article in each column laterally out of said opening for collection at said gate member.

8. Apparatus according to claim 6 in which at least the exit portion of each passageway comprises a further conveyor defining a lower surface thereof and movable at a continuous speed having a component of motion parallel to said first mentioned conveyor comprising said containers which is equal to said continuous speed of said first mentioned conveyor, whereby each said further conveyor assists the descent by gravity of the rows of articles to said containers.

* * * * *